United States Patent [19]

Hogenson

[11] 4,114,234

[45] Sep. 19, 1978

[54] LOCKABLE ATTACHMENT MEANS FOR LUGGAGE

[76] Inventor: Lavernon S. Hogenson, Box 66, Hingham, Mont. 59528

[21] Appl. No.: 798,894

[22] Filed: May 20, 1977

[51] Int. Cl.[2] ..... A45C 13/20; A45F 5/10

[52] U.S. Cl. ..... 16/114 R; 24/73 CS

[58] Field of Search ..... 24/73 CE, 73 CS, 73 SA; 16/110 R, 114 R, 114 B; 70/233

[56] References Cited

U.S. PATENT DOCUMENTS

| | | | |
|---|---|---|---|
| 486,256 | 11/1892 | Leehey et al. | 24/73 CS |
| 2,042,808 | 6/1936 | Seebeck | 24/73 CS |
| 3,756,048 | 9/1973 | Portus | 70/233 |

FOREIGN PATENT DOCUMENTS

| | | | |
|---|---|---|---|
| 1,404,062 | 8/1975 | United Kingdom | 16/114 R |

*Primary Examiner*—Louis K. Rimrodt
*Attorney, Agent, or Firm*—James D. Givnan, Jr.

[57] ABSTRACT

A length of chain of open link construction is insertable through luggage handles to enable carrying of both pieces of luggage with but one hand. A hook member, adjacent one end of the chain, is engageable with a selected link to assure proper positioning of the luggage pieces to one another. Eyelets, adjacent opposite ends of the chain, receive a lock shackle for locking the pieces together.

1 Claim, 4 Drawing Figures

LOCKABLE ATTACHMENT MEANS FOR LUGGAGE

BACKGROUND OF THE INVENTION

The present invention concerns an attachment in the form of a chain or other flexible member for luggage to enable the temporary joining of luggage pieces for purposes of traveler convenience.

A traveler with more than two pieces of luggage is normally dependent upon assistance which is not always readily available at airports, railroad stations, etc., and accordingly the traveler is delayed until such assistance is available. When traveling with a briefcase or attache case, one hand must be utilized for carrying same restricting the unassisted traveler to but one suitcase or other piece of luggage. The further entrusting of a small piece of luggage, such as a briefcase, to various luggage handling facilities is inadvisable from the risk of loss or pilferage standpoint.

SUMMARY OF THE PRESENT INVENTION

The present invention is embodied in a flexible attachment for luggage which enables the traveler to securely interconnect two pieces of luggage to enable carrying of same with one hand and thereafter permits ready separation of same when desired with the attachment stored in a pocket or purse.

The attachment is disclosed as a length of lightweight chain having open links which can receive a hook member carried at one end of the chain. Accordingly, the chain may be threaded through the handles of two pieces of luggage and closed in a snug manner with insertion of the hook into engagement with a selected chain link. Disposed adjacent the chain ends are eyelets of a size to admit passage of a locking device when the eyelets are aligned with one another. From the above it will be seen that the luggage pieces may be joined temporarily to enable one-handed carrying of same, say to a luggage scale at an airport, and thereat separated to enable the traveler to personally carry the briefcase aboard the plane. The attachment may be used in pairs to assure maintenance of the two pieces in desired parallel relationship with one another.

Important objectives of the present luggage attachment include the provision of an attachment enabling the convenient joining and separation of luggage to facilitate carrying of same by the traveler; the provision of an attachment for luggage which, when not in use, may be conveniently carried within the traveler's purse or pocket; the provision of a luggage attachment which provides for the locking together of two pieces of luggage; the provision of a luggage attachment which is readily adjustable to enable coupling of two pieces of luggage so as to permit both pieces to rest on the floor to avoid any tendency of the luggage to tip over. These and other objectives will become subsequently apparent upon an understanding of the following description of the attachment.

DETAILED DESCRIPTION OF THE PREFERRED EMBODIMENT

Figure 1:
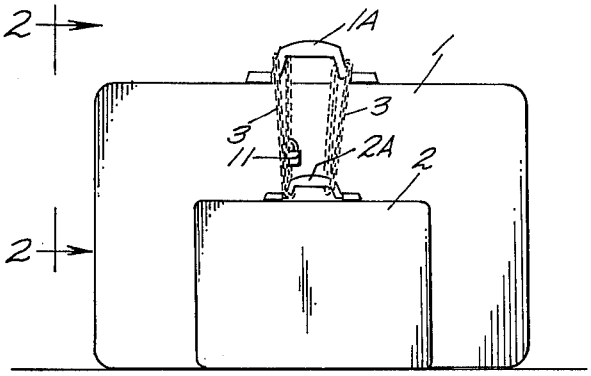
FIG. 1 is an elevational view of two pieces of luggage joined with the present attachment shown schematically.
Figure 2:
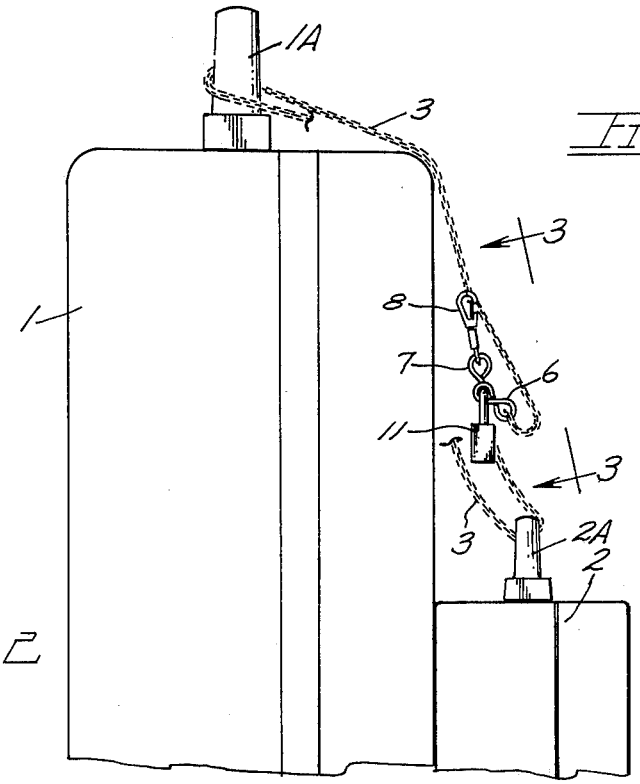
FIG. 2 is a view taken along line 2—2 of FIG. 1 on an enlarged scale.
Figure 3:
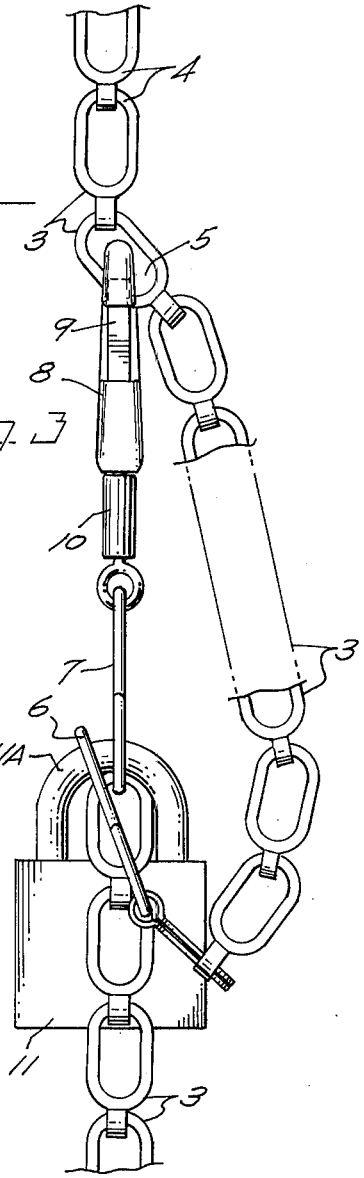
FIG. 3 is a view taken along line 3—3 of FIG. 2 on an enlarged scale.
Figure 4:
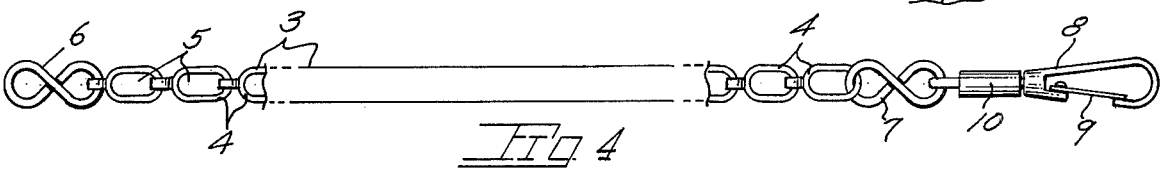
FIG. 4 is a plan view of the present attachment separated from luggage and sectioned for purposes of illustration.

With continuing reference to the accompanying drawing wherein applied reference numerals indicate parts similarly identified in the following specification, the reference numerals 1 and 2 indicate two typical pieces of luggage which may be of different size such as a suitcase and a brief or attache case. Indicated at 1A and 2A are handles for the respective pieces of luggage.

The present attachment includes a flexible elongate member such as a length of lightweight chain at 3 which may be used in a dual manner as shown. The chain is comprised of links 4 each defining an opening 5 for the passage of a later described hook member. Affixed to one end of chain 3 is an eyelet 6 while a companion eyelet at 7 is affixed adjacent the opposite end of the chain. Also adjacent one end of chain 3 is a hook member 8 which may be in the form of a snap fitting and desirably include a flexible spring leaf 9 to prevent inadvertent uncoupling of the hook member with a selected chain link. To prevent chain twisting, I provide a swivel at 10 intermediate hook member 8 and eyelet 7.

A lock at 11 with a shackle 11A secures the figure 8 shaped two double eyelets 6 and 7 together subsequent to chain passage through luggage handles 1A, 2A.

In use, member 3 is entrained through the luggage handles and hook member 8 inserted into a selected chain link 4 in a manner causing member 3 to be somewhat taut so as to permit both pieces of luggage to be placed on a floor without risk of tipping over. To lock the loop of chain about said handles, the eyelet 6 is brought into alignment with eyelet 7 and the lock shackle 11A inserted therethrough. When used in a dual manner as shown in FIG. 1, the remaining attachment need not be locked, in which case the eyelet 6 may be inserted into hook member 8 or left dangling.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. An attachment for temporarily interconnecting the handles of two pieces of luggage to enable convenient carrying of both pieces with one hand yet allowing both pieces to also rest on the ground without risk of tipping over, said attachment comprising, a length of chain for looped passage through the luggage handles, a lock including a shackle, double eyelets disposed one each at opposite ends of said chain and adapted when an eyelet of one is registered with an eyelet of the remaining double eyelet to receive the lock shackle through the registered eyelets to secure the chain ends to one another to form a locked chain loop passing through the luggage handles, and a snap fitting with swivel attached to a remaining eyelet of one of said double eyelets and engageable with a selected link of the chain to permit the removal of slack from the chain loop to achieve a desired relationship between the pieces of luggage regardless of varying size relationships between any two pieces of luggage to be carried

* * * * *